US009484172B2

(12) United States Patent
Connell

(10) Patent No.: US 9,484,172 B2
(45) Date of Patent: Nov. 1, 2016

(54) ELECTRICAL CONTACT SETS

(71) Applicant: Johnson Electric S.A., Murten (CH)

(72) Inventor: Richard Anthony Connell, Cambridge (GB)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 14/701,969

(22) Filed: May 1, 2015

(65) Prior Publication Data

US 2015/0318134 A1 Nov. 5, 2015

(30) Foreign Application Priority Data

May 1, 2014 (GB) ..... 1407705.1

(51) Int. Cl.

| | |
|---|---|
| ***H01H 51/22*** | (2006.01) |
| ***H01H 50/60*** | (2006.01) |
| ***H01H 50/24*** | (2006.01) |
| ***H01H 50/44*** | (2006.01) |
| ***H01H 50/14*** | (2006.01) |
| ***H01H 1/54*** | (2006.01) |

(52) U.S. Cl.

CPC ..... *H01H 50/60* (2013.01); *H01H 1/54* (2013.01); *H01H 50/14* (2013.01); *H01H 50/24* (2013.01); *H01H 50/443* (2013.01); *H01H 51/229* (2013.01); *H01H 51/2272* (2013.01)

(58) Field of Classification Search

CPC ..... H01H 51/12
USPC ..... 335/128, 181
See application file for complete search history.

(56) References Cited

U.S. PATENT DOCUMENTS

| | | | | |
|---|---|---|---|---|
| 2,955,174 | A | 10/1960 | Richert | |
| 4,259,652 | A * | 3/1981 | Mattson | H01H 51/2281 335/128 |
| 4,366,459 | A * | 12/1982 | Vitola | H01H 51/12 335/128 |
| 5,117,209 | A * | 5/1992 | Sato | H01H 50/026 335/78 |
| 5,359,305 | A * | 10/1994 | Kitamura | H01H 50/16 335/129 |
| 6,856,219 | B2 * | 2/2005 | Kawai | H01H 59/0009 200/181 |
| 7,286,030 | B2 * | 10/2007 | Janot | H01H 49/00 335/4 |

(Continued)

FOREIGN PATENT DOCUMENTS

| | | |
|---|---|---|
| DE | 102010032456 A1 | 2/2012 |
| EP | 0 437 209 A2 | 7/1991 |

(Continued)

*Primary Examiner* — Alexander Talpalatski
(74) *Attorney, Agent, or Firm* — Muncy, Geissler, Olds & Lowe, P.C.

(57) ABSTRACT

An electrical contactor has a first terminal having a first fixed contact; a second terminal having a second fixed contact; a first electrically-conductive movable arm in electrical communication with the first terminal and having a first movable contact thereon; a second electrically-conductive movable arm in electrical communication with the second terminal and having a second movable contact thereon, counter-opposed to the first moveable arm; and an actuator for moving the first and second moveable arms in opposing directions. The first moveable contact and the second fixed contact form a primary contact set, and the second moveable contact and the first fixed contact form a secondary contact set, first and second moveable arms thereby forming a current-sharing arm pair between first and second terminals.

14 Claims, 6 Drawing Sheets

(56) References Cited

U.S. PATENT DOCUMENTS

| | | | | |
|---|---|---|---|---|
| 7,477,119 | B2 * | 1/2009 | Wu | H01H 50/043 335/128 |
| 7,659,800 | B2 * | 2/2010 | Gruner | H01H 1/26 335/185 |
| 8,237,523 | B2 * | 8/2012 | Helmreich | H01H 50/548 200/400 |
| 8,514,040 | B2 * | 8/2013 | Gruner | H01H 1/54 335/125 |
| 8,680,957 | B2 * | 3/2014 | Kato | H01H 50/043 335/202 |
| 8,773,226 | B2 * | 7/2014 | Li | H01H 51/2272 335/128 |
| 2012/0206222 | A1 | 8/2012 | Gruner | |
| 2013/0181793 | A1 | 7/2013 | Bauer et al. | |
| 2015/0015349 | A1 | 1/2015 | Connell | |

FOREIGN PATENT DOCUMENTS

| | | |
|---|---|---|
| EP | 2 613 161 A1 | 7/2013 |
| GB | 1564637 | 4/1980 |
| GB | 2418780 | 4/2006 |
| JP | H 06260070 | 9/1994 |
| WO | WO2010090619 A2 | 8/2010 |

* cited by examiner

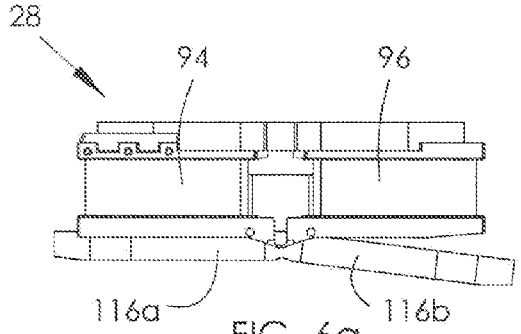

FIG. 6a

Left Hand Side armlet of rocking armature latched

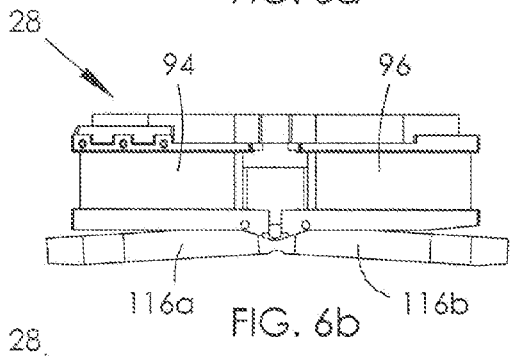

FIG. 6b

Left Hand Side coil energised

Left Hand Side coil de-magnetised

Right Hand Side coil experiences greater magnetic flux

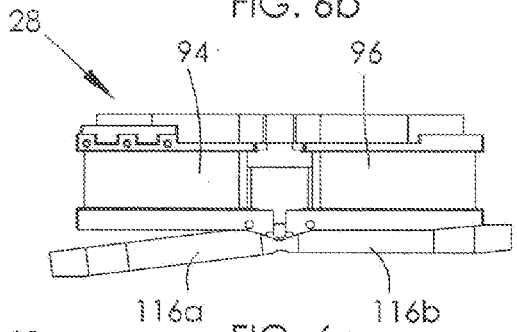

FIG. 6c

Right Hand Side armlet of rocking armature latched

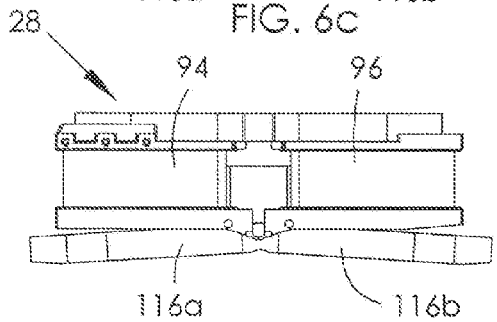

FIG. 6d

Right Hand Side coil energised

Right Hand Side coil de-magnetised

Left Hand Side coil experiences greater magnetic flux

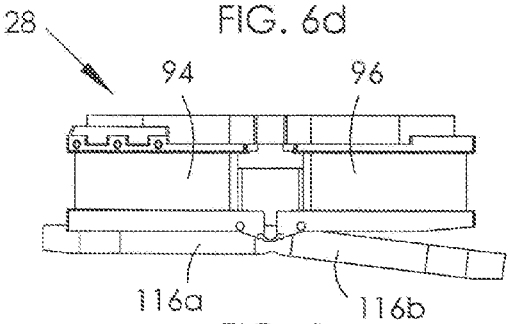

FIG. 6e

Left Hand Side armlet of rocking armature latched

ELECTRICAL CONTACT SETS

CROSS REFERENCE TO RELATED APPLICATIONS

This non-provisional patent application claims priority under 35 U.S.C. §119(a) from Patent Application No. GB1407705.1 filed in The United Kingdom on May 1, 2014, the entire contents of which are hereby incorporated by reference.

FIELD OF THE INVENTION

This invention relates to an electrical contactor, particularly but not necessarily exclusively for moderate AC switching contactors employed in modern electricity meters, so-called 'smart meters', for performing a load-disconnect function at normal domestic supply mains voltages, typically being 100 V AC to 250 V AC.

Additionally, it is a desire that the opening and closing timing of the electrical contacts in such a moderate-current switch should be more precisely controlled to reduce or prevent arcing damage thereby increasing their operational life.

BACKGROUND OF THE INVENTION

It is known that many electrical contactors are capable of switching nominal current at, for example, 100 Amps, for a large number of switching load cycles. The switch contacts utilize a suitable silver-alloy which prevents tack-welding. The switch arm carrying the movable contact must be configured to be easily actuated for the disconnect function, with minimal self-heating at the nominal currents concerned.

Most meter specifications stipulate satisfactory nominal-current switching through the operational life of the device without the contacts welding. However, it is also required that, at moderate short-circuit fault conditions, the contacts must not weld and must open on the next actuator-driven pulse drive. At much higher related dead-short fault conditions, it is stipulated that the switch contacts may weld safely. In other words, the movable contact set must remain intact, and must not explode or emit any dangerous molten material during the dead-short duration, until protective fuses rupture or circuit breakers drop-out and disconnect the Live mains supply to the load. This short-circuit duration is usually for only one half-cycle of the mains supply, but in certain territories it is required that this short-circuit duration can be as long as four full cycles.

In Europe, and most other countries, the dominant meter-disconnect supply is single-phase 230 V AC at 100 Amps, and more recently 120 Amps, in compliance with the IEC 62055-31 specification. Technical safety aspects are also covered by other related specifications such as UL 508, ANSI C37.90.1, IEC 68-2-6, IEC 68-2-27, IEC 801.3.

There are many moderate-current meter-disconnect contactors known that purport to satisfy the IEC specification requirements, including withstanding short-circuit faults and nominal current through the operational life of the device. The limiting parameters may also relate to a particular country, wherein the AC supply may be single-phase with a nominal current in a range from 40 to 60 Amps at the low end, and up to 100 Amps or more recently to a maximum of 120 Amps. For these metering applications, the basic disconnect requirement is for a compact and robust electrical contactor which can be easily incorporated into a relevant meter housing.

In the context of the IEC 62055-31 specification, the situation is more complex. Meters are configured and designated for one of several Utilization Categories (UC) representing a level of robustness regarding the short-circuit fault-level withstand, as determined by certain tests carried out for acceptable qualification or approval. These fault-levels are independent of the nominal current rating of the meter.

Acting as an actuator means, there will typically be an armature or plunger which is driven to control the opening and closing of the contacts. However, a typical actuator can only provide an actuation in a single direction, which can cause problems in multi-pole contactors.

Some contactors utilize parallel or substantially parallel movable arms which are simultaneously actuated by a wedge-shaped member which is forced between them, separating the arms and breaking two contacts simultaneously. However, purely physical means of opening and closing the moveable arms ignores the possible magnetic forces which are generated by passing current through the arms, which could be harnessed to smooth the opening and closing of the contacts.

The present invention seeks to provide solutions to the afore-mentioned problems.

SUMMARY OF THE INVENTION

According to a first aspect of the invention, there is provided an electrical contactor comprising: a first terminal having at least one first fixed electrical contact; a second terminal having at least one second fixed electrical contact; a first electrically-conductive movable arm in electrical communication with the first terminal and having at least one first movable electrical contact thereon; a second electrically-conductive movable arm in electrical communication with the second terminal and having at least one second movable electrical contact thereon, counter-opposed to the first electrically-conductive moveable arm; and actuator means for providing motive force to the first and second electrically-conductive moveable arms in opposing directions; wherein the or each first moveable electrical contact and the or each second fixed contact form a primary contact set, and the or each second moveable electrical contact and the or each first fixed contact form a secondary contact set, counter-opposed first and second moveable arms thereby forming a current-sharing arm pair between first and second terminals.

The advantage of such an electrical contactor is that current load is shared between the first and second moveable arms. Electrical arcing between contacts arises when the contacts are close to one another, yet not quite closed. The erosion energy present during arcing is proportional to the current load, and therefore sharing current between the arms reduces said erosion energy.

Arcing also causes heating of the contacts, which may lead to the melting of the contacts. Reducing the erosion energy advantageously allows for the contacts of the respective contact sets to be reduced in size; as less energy is transferred between contacts during arcing, the heating effect will be reduced, and therefore smaller contacts will not melt and/or tack weld as easily.

Although the actuator means may provide simultaneous urging of the movable arms, preferably, the primary contact set may be a lead contact and the secondary contact set may be a lag contact. In this case, the actuator means is adapted to actuate the first moveable electrical contact into contact with the second fixed electrical contact before the second moveable electrical contact is actuated into contact with the first fixed electrical contact.

If a lead-lag contact arrangement is utilized, then the lead contact may initially carry the current at contact closure. This contact can be of a standard size so as to more easily dissipate the heat associated with the contact erosion energy so as to avoid tack welding.

However, since the contact will already have closed by the time the lag contact closes, there will be minimal risk of arcing associated with the lag contact closure. With this in mind, the lag contacts can be made to be considerably smaller than the lead contacts, thereby reducing the amount of conductive material used to make the contact. Since the conductive material will typically be a precious metal such as silver, this can greatly reduce the manufacturing cost of the contactor.

Preferably, the current through the counter-opposed first and second moveable arms may flow in the same direction, thereby creating an attractive magnetic force between the first and second moveable arms.

The attractive magnetic force between the moveable arms once the contacts are closed helps to restrict contact bounce. Contact bounce can cause physical damage to the contacts due to the force of the impact, but more deleteriously, can result in uncontrolled contact closure periods. It is advantageous to match the closing of the contacts to a zero-crossing point of the associated load current. Doing so minimizes the available contact erosion energy, which can lead to arcing. Contact bounce makes it difficult to match the zero-crossing point to the closure time, and it is therefore highly advantageous to attempt to restrict contact bounce to a minimum.

Preferably, at least one of the moveable arms may have a single-blade arrangement. More preferably, the first moveable arm may have a single-blade arrangement, having the first moveable contact thereon, the second fixed contact being sized and positioned to match the first moveable contact. Furthermore, at least one of the moveable arms may have a split-blade arrangement, and more preferably, the second moveable arm may have a split-blade arrangement including two blades, two of the second moveable contacts being provided, one on each blade, there being two first fixed contacts sized and positioned to match the two second moveable contacts.

Further preferably, the contacts of the primary contact set are dimensioned differently to the contacts of the secondary contact set.

Additionally splitting the moveable arms into individual blades leads to a further current sharing effect, which beneficially allows for a further reduction in the size, and therefore amount of precious metal used, of the contacts of the secondary contact set.

Preferably, the electrical contactor may further comprise: a third terminal having a third fixed member with at least one third fixed electrical contact; a fourth terminal having a fourth fixed member with at least one fourth fixed electrical contact; a third electrically-conductive movable arm in electrical communication with the third terminal and having at least one third movable electrical contact thereon; and a fourth electrically-conductive movable arm in electrical communication with the fourth terminal and having at least one fourth movable electrical contact thereon, counter-opposed to the third electrically-conductive moveable arm; wherein the or each third moveable electrical contact and the or each fourth fixed contact form a tertiary contact set, and the or each fourth moveable electrical contact and the or each third fixed contact form a quaternary contact set, third and fourth moveable arms thereby forming a further current-sharing arm pair between third and fourth terminals.

Typically, electrical contactors are formed as two-pole devices to comply with safety specifications. It is therefore advantageous to provide a second pair of current-sharing arms to form said two-pole contactor.

Preferably, the tertiary contact set may be a lead contact and the quaternary contact set may be a lag contact, the actuation means being adapted to actuate the third moveable electrical contact into contact with the fourth fixed electrical contact before the fourth moveable electrical contact is actuated into contact with the third fixed electrical contact.

Preferably, the third moveable arm, terminal, fixed contact and moveable contact may be identical or substantially identical in form and/or orientation to the first moveable arm, terminal, fixed contact and moveable contact.

The third and fourth moveable arms are constructed in a substantially similar manner to the first and second moveable arms, thereby retaining all of the advantageous features thereof.

Preferably, the or each movable arm may include at least two electrically-conductive overlying layers, thereby reducing a flexure force.

By laminating the or each movable arm with multiple electrically-conductive layers, the deleterious effects of tack-welding can be reduced, since the current will be shared through the electrically-conductive layers in a similar manner to the current-sharing achieve when the moveable arms are separated into multiple blades.

Preferably, the current through the counter-opposed third and fourth moveable arms flows in the same direction, thereby creating an attractive magnetic force between the third and fourth moveable arms.

Again, the current flow through the third and fourth arms can create a magnetically attractive force to inhibit the effects of contact bounce by providing a more secure closure of the contact sets.

Preferably, the current flow through the third and fourth moveable arms flows parallel and in opposition to the current flow through the first and second moveable arms, and preferably still a repulsive magnetic force may be created between the second and fourth moveable arms as a result of the parallel and opposite current flow between the current-sharing arm pair, and the further current-sharing arm pair.

By flowing current through the further current-sharing arm pair in the opposite direction to the first current-sharing arm pair, a magnetically repulsive force will be generated between the closest arms of each arm pair, in this case, the second and fourth moveable arms. This provides a further contact closure force, thereby improving the contactor's resistance to contact bounce.

Preferably, the actuation means may include a centrally mounted magnet, first and second drivable coils located either side of the magnet, a magnetically-attractable rocking armature pivotable at a point between the first and second coils, and an actuation element connected to an end of the rocking armature for actuating each movable arm; wherein driving the first coil causes a decrease of magnetic flux in the first coil, causing a corresponding increase in magnetic flux in the second coil, the rocking armature thus latching to the second coil, thereby actuating each movable arm in a first direction, and driving the second coil causes a decrease of magnetic flux in the second coil, causing a corresponding increase in magnetic flux in the first coil, the rocking armature thus latching to the first coil, thereby actuating each movable arm in a second direction.

The advantage of an electrical contactor having a pivoting actuator is that a compact device can be created in which two actuations can be simultaneously made, should there be an actuation element attached at either end of the rocking armature. This allows for an opposingly cantilevered arrangement of movable arms wherein a controlled, either being simultaneous or lead/lag, opening or closing of contacts can be achieved in a single latching motion. The first and second, and if provided, third and fourth, moveable arms can therefore be actuated to open and close in concert.

Preferably, the first and second coils may be interconnected to a common center connection.

Interconnecting the first and second coils may beneficially allow the first coil to experience a net tempering or feedback effect when the second coil is driven, and vice versa. Careful optimization of the features of the coils allows for a dynamic delay to be added to the closing of the contacts, enabling the contact erosion energy to be minimized by tuning the closing time to a zero-crossing of an associated load current waveform.

Preferably, the rocking armature includes two armlets positioned at an obtuse angle to one another.

Such a configuration of rocking armature ensures that a reasonable actuation occurs on latching, whilst also ensuring that the unlatched armlet of the armature remains within the generated magnetic field of the opposing coil.

The electrical contactor may preferably further comprise a DC power supply for energizing the first and/or second coil, the DC power supply outputting drive pulses via a drive circuit.

Alternatively, the electrical contactor may further comprise an AC power supply for energizing the first and/or second coil, the AC power supply outputting drive pulses via a drive circuit.

Direct DC driven or AC driven contactors can be conceived, and a feedback stabilized actuation means can be attuned to the zero-crossing of the associated load waveform to reduce the deleterious effects of contact erosion due to arcing.

The AC drive pulse may preferably have a half-cycle waveform profile, so as to reduce erosion energy between the contacts. Alternatively and most preferably, the AC drive pulse may have a quarter-cycle waveform profile, so as to prevent contact separation prior to peak load current.

Preferably, the driving of one of the coils may induce an electromagnetic field in the other coil, causing a mean tempering flux and damping effect to synchronize or substantially synchronize the opening and closing of the contacts with the AC waveform zero-crossing.

The truncation of the drive pulses to either half- or quarter-cycles helps to limit the damaging contact erosion energy available on contact closure. The quarter-cycle pulse is most advantageous, as the closing of the contacts cannot occur prior to the peak load current point. Closure before this point would ordinarily result in large and detrimental contact erosion energies.

Preferably, the or each second moveable contact may be adapted to lead during contact opening and the or each first moveable contact may be adapted to lag during contact opening.

By providing a lead-lag arrangement, the contacts associated with the second moveable arm can be reduced in size, since they will not experience the same heating effects of the lead contacts. This advantageously allows for a reduction in the amount of precious metal used in the formation of the contact sets.

Contact bounce can be a destructive force to the electrical contacts, and therefore providing a method of enhancing contact closure is therefore advantageous to obviate said deleterious effects.

This can be readily achieved either by the provision of counter-opposed moveable arms within a single contact set. Since the current flows through the arms uni-directionally, the arms are attracted to one another. Providing a second contra-oriented set of arms can cause a repulsive effect to further retain the contacts in a closed configuration. Providing these effects concurrently compounds their benefits.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

FIGS. 6*a* to 6*e* show the actuator of FIG. 3 at various positions through its actuation cycle, inclusive of annotations to aid clarity;

DETAILED DESCRIPTION OF THE PREFERRED EMBODIMENTS

Figure 1:
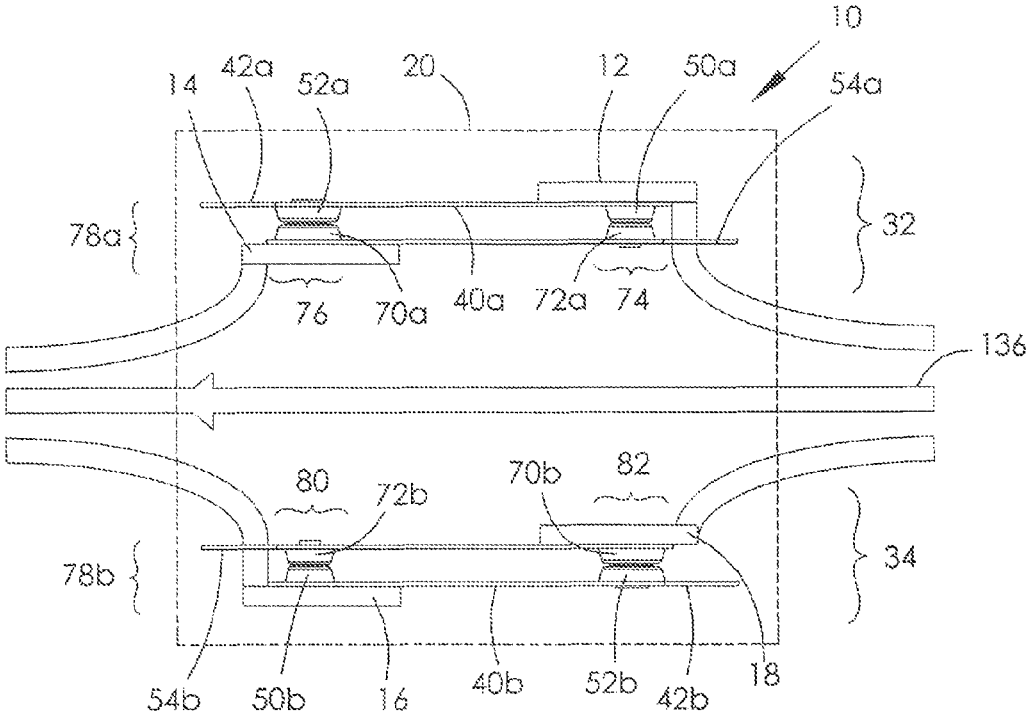
FIG. 1 shows a diagrammatic representation of a first embodiment of an electrical contactor, in accordance with the first aspect of the invention.
Figure 2:
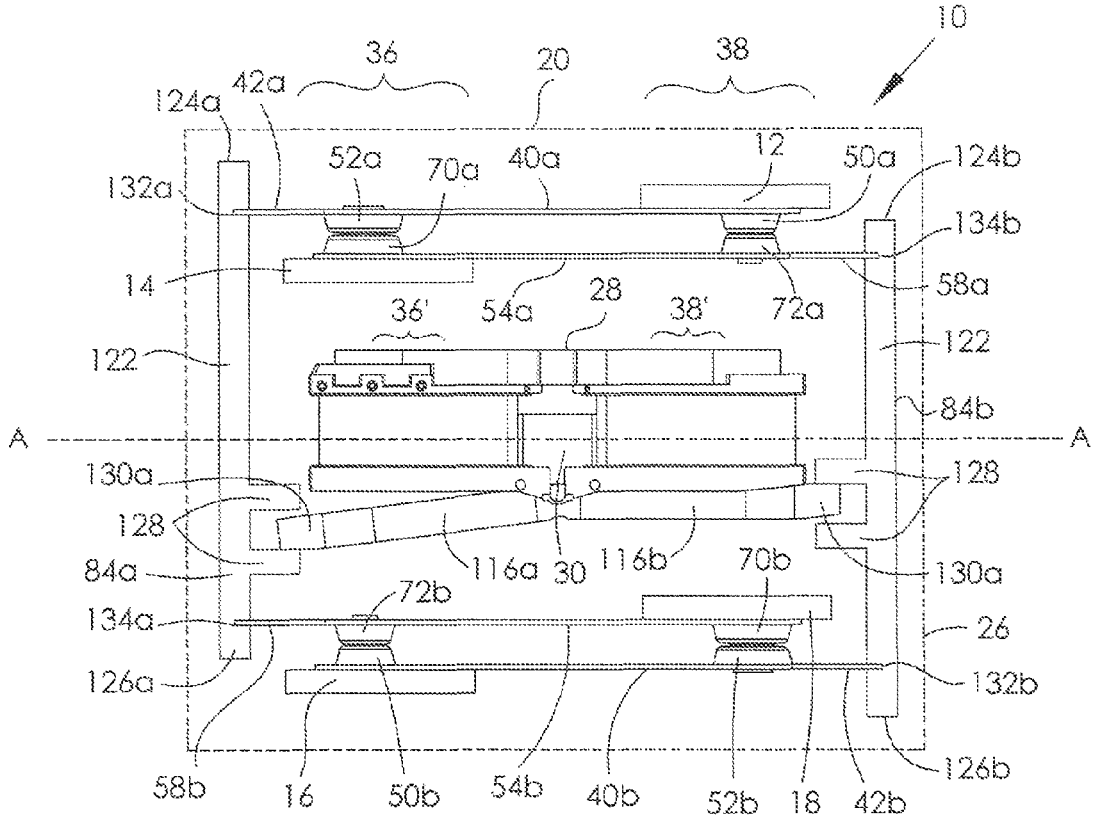
FIG. 2 shows a plan view of the electrical contactor of FIG. 1, the contacts being in the contacts-closed configuration.
Figure 3:
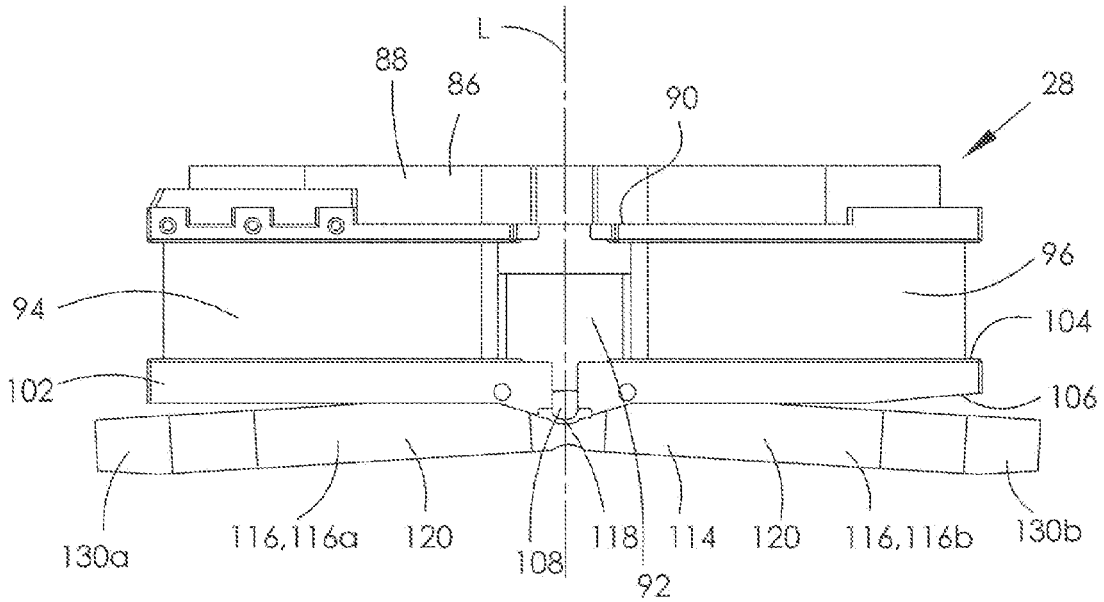
FIG. 3 shows an enlarged plan view of the actuator of the electrical contactor of FIG. 2.
Figure 4:
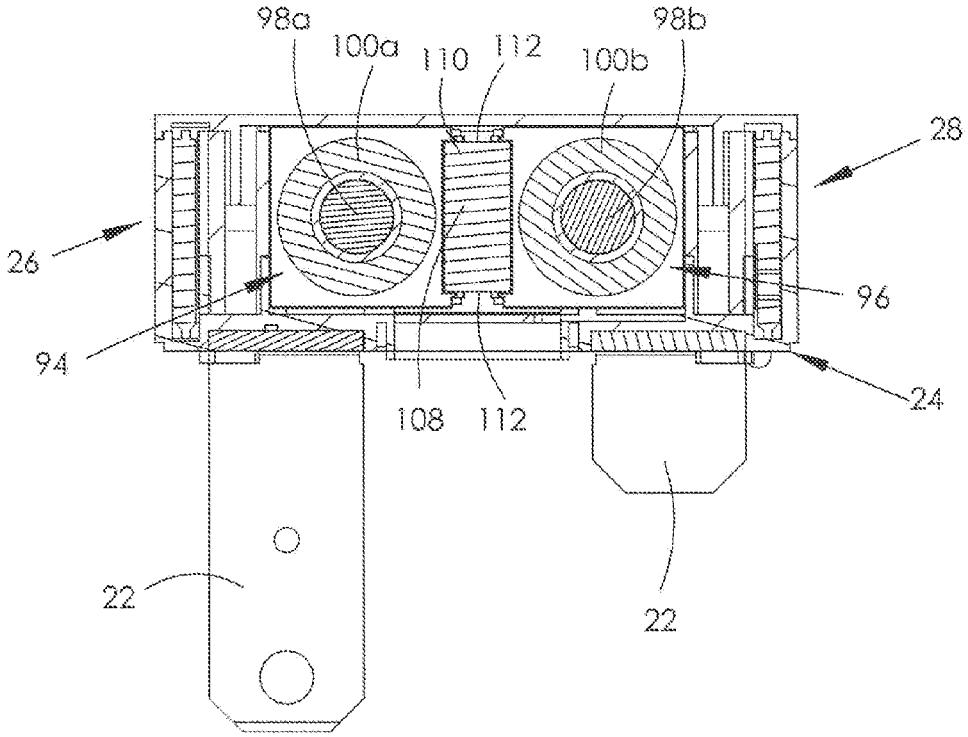
FIG. 4 is a side cross-sectional view of the electrical contactor of FIG. 2, the cross-section being taken through line A-A shown in FIG. 2.

Referring firstly to FIGS. 1 to 4 of the drawings, there is shown a first embodiment of an electrical contactor, globally shown at 10 and in this case being a two-pole device. Although a two-pole device is described, the suggested improvements may be applicable to a single pole device or a device having more than two poles.

The contactor 10 includes first, second, third and fourth terminals 12, 14, 16, 18 each extending from a contactor housing 20, terminating in a terminal stab 22, and being mounted to a housing base 24 and/or an upstanding perimeter wall 26 of the contactor housing 20. The housing base is representatively shown as a dashed line, and housing cover is not shown for clarity.

The four terminals 12, 14, 16, 18 are preferably arranged so as to define vertices of a rectangle within the housing 20, and an actuator 28 of an actuation means 30 is inserted in the intermediate space. The contactor 10 can therefore be divided according to the positions of these terminals 12, 14, 16, 18; the first and second terminals 12, 14 can be found in an upper portion 32 of the contactor housing 20, and the third and fourth terminals 16, 18 are located in a lower portion 34 of the contactor housing. Similarly, the second and third terminals 14, 16 are located on a left-hand side 36 of the contactor housing 20, and the first and fourth terminals 12, 18 are located on a right-hand side 38.

Figure 5:
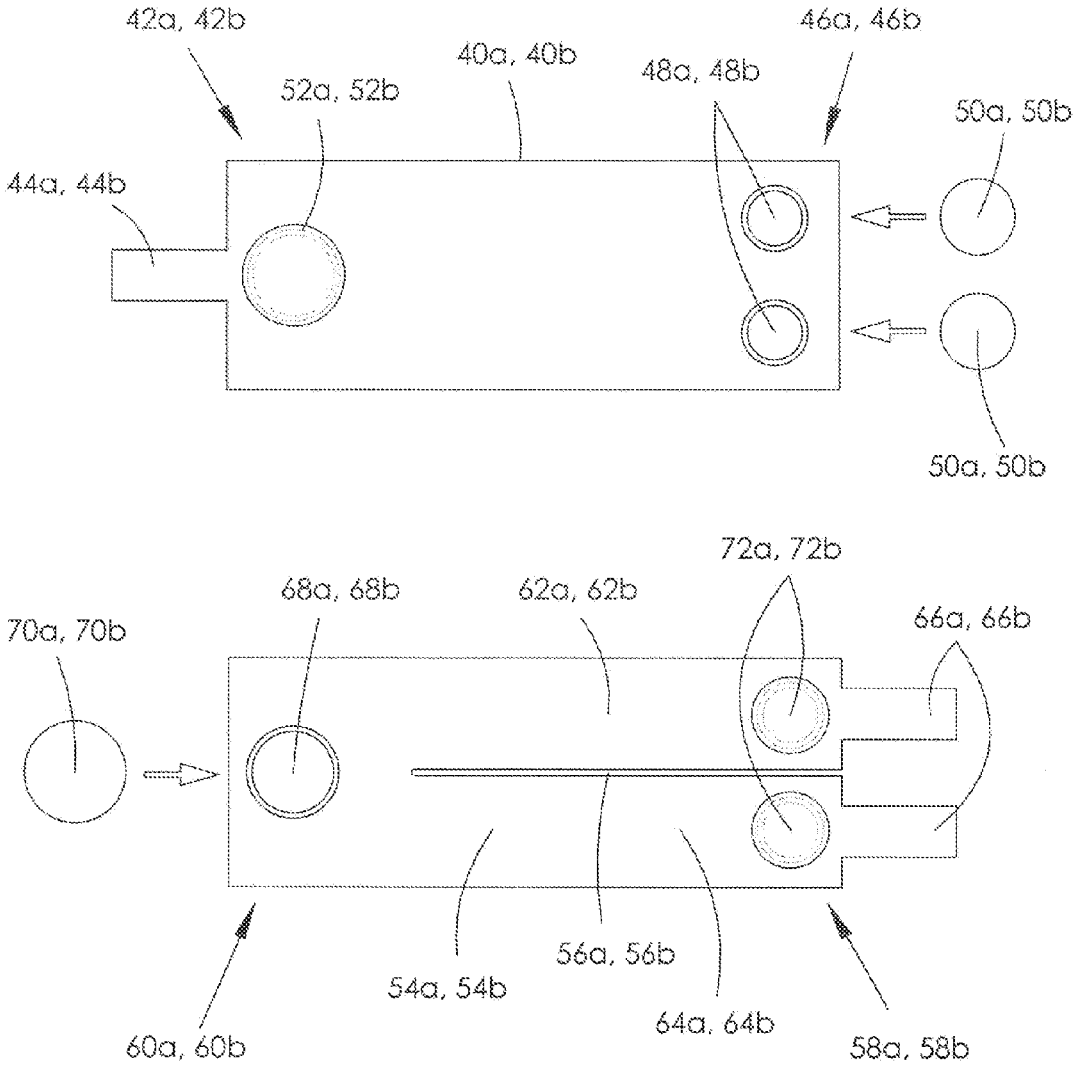
FIG. 5 shows a plan view of first or third and second or fourth moveable arms for use with the electrical contactor shown in FIG. 2.

From the first terminal 12, towards the second terminal 14, extends a first moveable arm 40*a*, being formed as an electrically-conductive, flexible blade. From a distal end 42*a* of the first moveable arm 40*a* extends an elongate tang 44*a*, and at a proximal end 46*a* are two apertures 48*a*, spaced apart from one another along a lateral axis of the first moveable arm 40*a*. See FIG. 5.

The first moveable arm 40*a* is affixed to the first terminal 12 via two first fixed contacts 50*a*, secured to the first terminal 12 via the apertures 48*a*. At the distal end 42*a* is positioned a first moveable contact 52*a*. The contacts 50*a*, 52*a* are formed from an electrically-conductive material, typically silver, and may be sized so as to be at least half as wide as the first moveable arm 40*a*.

From the second terminal 14, towards the first terminal 12, extends a second moveable arm 54*a*, being formed as an electrically-conductive, flexible blade, having a central split 56*a* extending the majority of the length of the blade from a distal end 58*a* towards the proximal end 60*a*. This arm configuration is therefore known as a bi-bladed arrangement, having left and right blades 62*a*, 64*a*.

From the distal end 58*a* of each of the left and right blades 62*a*, 64*a* extends an elongate tang 66*a*, similar to that of the first moveable arm 40*a*. At the proximal end 60*a* is a single aperture 68*a*.

The second moveable arm 54*a* is affixed to the second terminal 14 via one second fixed contact 70*a*, secured to the second terminal 14 via the aperture 68*a*. At the distal end 60*a* of each of the left and right blades 62*a*, 64*a* is a second moveable contact 72*a*. Again, the contacts 70*a*, 72*a* are formed from an electrically-conductive material, typically silver.

The first moveable contact 52*a* and the second fixed contact 70*a* are preferably complementarily sized and shaped, and together form a primary contact set 74. The second moveable contacts 72*a* and the first fixed contacts 50*a* are also preferably complementarily sized and shaped, and together form a secondary contact set 76.

In combination, the primary contact set 74, secondary contact set 76 and first and second moveable arms 40*a*, 54*a* form a current-sharing arm pair 78*a*.

From the third terminal 16, being diagonally opposed to the first terminal 12, towards the fourth terminal 18, extends a third moveable arm 40*b*, being formed as an electrically-conductive, flexible blade. From a distal end 42*b* of the third moveable arm 40*b* extends an elongate tang 44*b*, and at a proximal end 46*b* are two apertures 48*b*, spaced apart from one another along a lateral axis of the third moveable arm 40*b*.

The third moveable arm 40*b* is affixed to the third terminal 16 via two third fixed contacts 50*b*, secured to the third terminal 16 via the apertures 48*b*. At or adjacent to the distal end 42*b* is positioned a third moveable contact 52*b*. The contacts 50*b*, 52*b* are formed from an electrically-conductive material, typically silver.

From the fourth terminal 18, towards the third terminal 16, extends a fourth moveable arm 54*b*, being formed as an electrically-conductive, flexible blade, having a central split 56*b* extending the majority of the length of the blade from a distal end 58*b* towards the proximal end 60*b*. This arm configuration is also a bi-bladed arrangement, having left and right blades 62*b*, 64*b*.

From the distal end 58*b* of each of the left and right blades 62*b*, 64*b* extends an elongate tang 66*b*, similar to those of the second moveable arm 54*a*. At the proximal end 60*b* is a single aperture 68*b*.

The fourth moveable arm 54*b* is affixed to the fourth terminal 14 via one fourth fixed contact 70*b*, secured to the fourth terminal 14 via the aperture 68*b*. At the distal end 60*b* of each of the left and right blades 62*b*, 64*b* is a fourth moveable contact 72*b*. Again, the contacts 70*b*, 72*b* are formed from an electrically-conductive material, typically silver.

The third moveable contact 52*b* and the fourth fixed contact 70*b* are preferably complementarily sized and shaped, and together form a tertiary contact set 80. The fourth moveable contacts 72*b* and the third fixed contacts 50*b* are also preferably complementarily sized and shaped, and together form a quaternary contact set 82.

In combination, the tertiary contact set 80, quaternary contact set 82 and third and fourth moveable arms 40*b*, 54*b* form a further current-sharing arm pair 78*b*.

It is important that the contacts used have adequate top-lay silver-alloy thickness in order to withstand the arduous switching and carrying duties involved, thus reducing contact wear. Prior art electrical contacts of an 8 mm diameter bi-metal have a silver-alloy top-lay thickness in a range 0.65 mm to 1.0 mm. This results in a considerable silver cost.

To address the issue of tack welding between contacts under high short-circuit loads, a particular compound top-lay can be utilized, in this case enriching the silver alloy matrix with a tungsten-oxide additive. Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding. The tungsten-oxide additive raises the general melt-pool temperature at the switching point, which again discourages tack-welding, and due to the tungsten-oxide additive being a reasonable proportion of the total top-lay mass, for a given thickness, its use provides a cost saving.

The American National Standards Institute (ANSI) requirements are particularly demanding for nominal currents up to 200 Amps. The short-circuit current is 12 K.Amp rms, but for a longer withstand duration of four full Load cycles, with 'safe' welding allowable. Furthermore, a "moderate" short-circuit current level of 5 K.Amps rms requirement may hold, wherein the contacts must not tack-weld over six full Load cycles.

Each movable arm 40*a*, 54*a*, 40*b*, 54*b* may therefore further include at least two electrically-conductive overlying layers, thereby effectively forming a laminated movable arm. Each layer is preferably thinner than single layer movable arms, and can therefore accommodate a greater heating effect. This will beneficially reduce the likelihood of tack-welding.

The actuation means 30 includes the centrally located actuator 28 and two slidable actuation elements 84*a*, 84*b*, and is capable of actuating each of the moveable arms 40*a*, 54*a*, 40*b*, 54*b*.

The actuator 28 preferably comprises a ferrous yoke 86 including a thin, substantially rectangular base plate 88. Extending from the upper rectangular face 90 along a lateral centerline L of the actuator 28 is a permanent magnet stack 92, thereby defining a left-hand side 36' and a right-hand side 38' of the actuator 28. The magnet stack 92 preferably comprises at least one rare-earth magnet. However, rather than a stack, a single unitary, preferably permanent, magnetic element may be utilized.

Extending from the left-hand side 36' of the upper rectangular face 90 of the base plate 88 is a first drivable coil 94, and extending from the right-hand side 38' of the upper rectangular face 90 is a second drivable coil 96. Each coil 94, 96 comprises a central, cylindrical ferrous core 98*a*, 98*b* around which is wrapped electrically-conductive wire windings 100*a*, 100*b* in a tight helix.

The yoke 86 further comprises a cap plate 102 having a substantially similar shape to the base plate 88, the cap plate 102 including upper and lower rectangular faces 104, 106. The lower rectangular face 106 abuts the upper edges of the permanent magnet stack 92 and the coils 94, 96.

On the upper face 104 of the cap plate 102 is a fulcrum 108 aligned along the lateral centerline L of the actuator 28. The fulcrum 108 comprises a freely rotating pivot pin 110 affixed to the cap plate 102 by two end caps 112.

There is further provided a rocking armature 114 integrally formed as two elongate opposing armlets 116, each connected at a central point 118 such that the body 120 of each armlet 116 is positioned at an obtuse angle to the other. The rocking armature 114 is connected to the freely rotating pivot pin 110, thereby allowing the rocking armature 114 to pivot about the fulcrum 108. Each armlet 116 is therefore associated with either the left-hand side 36' or the right-hand side 38' of the actuator 28, thereby defining a left-hand side armlet 116*a* and a right-hand side armlet 116*b*.

The actuation elements are provided as left-hand side and right-hand side sliding actuation elements 84*a*, 84*b* which interconnect the actuator 28 and the movable arms 40*a*, 54*a*, 40*b*, 54*b*. Each actuation element 84*a*, 84*b* comprises an elongate body 122 having first and second ends 124*a*, 124*b*, 126*a*, 126*b*, having in this case two projections 128 located centrally and slightly offset towards the first end 120 for engagement with a free end 130 of an armlet 116 of the rocking armature 114.

At the first end 124*a* of the left-hand side actuation element 84*a*, a first slotted lifter 132*a* for engaging with the tang 44*a* of the first moveable arm 40*a*. At the second end 126*a* of said actuation element 84*a* are two fourth slotted lifters 134*a*, which engage with the tangs 66*b* of the fourth moveable arm 54*b*.

Similarly, at the first end 124*b* of the right-hand side actuation element 84*b* are two second slotted lifters 134*b*, which engage with the tangs 66*a* of the second moveable arm 40*a*. At the second end 126*b* of said actuation element 84*b* is a third slotted lifter 132*b* for engaging with the tang 44*b* of the third moveable arm 40*b*.

The tang 44*a* of the first moveable arm 40*a* is engaged with the first slotted lifter 132*a* slightly further from the first end 124*a* of the left-hand side actuation element 84*a* than the equivalent tangs 66*a* of the second moveable arm 54*a* are from the first end 124*b* of the right-hand side actuation element 84*b*.

Similarly, the tang 44*b* of the third moveable arm 40*b* is engaged with the third slotted lifter 132*b* slightly further from the second end 126*b* of the right-hand side actuation element 84*b* than the equivalent tangs 66*b* of the fourth moveable arm 54*b* are from the second end 126*a* of the left-hand side actuation element 84*a*.

The left-hand side actuation element 84*a* engages with a free end 130*a* of the left-hand side armlet 116*a*, and the right-hand side actuation element 84*b* engages with a free end 130*b* of the right-hand side armlet 116*b*.

The first and second coils 94, 96 are individually drivable, and therefore can be driven sequentially to effect actuation of the rocking armature 116. Without driving the coils 94, 96, there is a magnetic flux present generated by the permanent magnet stack 92, which is spread across the left-hand side 36' and right-hand side 38' of the actuator 28. Under these circumstances, the rocking armature 114 will not experience any strong latching force to either side 36', 38'.

The contacts-open and contacts-closed conditions of the contactor 10 are illustrated in FIGS. 6*a* to 6*e* respectively, wherein the motion of the left- and right-hand side actuation elements 84*a*, 84*b* is shown, moving the tangs 44*a*, 44*b*, 66*a*, 66*b* of the movable arms 40*a*, 54*a*, 40*b*, 54*b*.

Driving of a coil 94, 96 causes a demagnetization affect in the associated coil 94, 96, and through the ferrous yoke 86 of the side 36, 38 of the actuator 28 in which the coil 94, 96 is located. This will cause a corresponding rise in the magnetic flux present in the opposing side 36, 38. The increased magnetic flux will therefore attract the rocking armature 114 to the opposing coil 96, 94. As such, an actuation sequence can be generated, as illustrated in FIGS. 6*a* to 6*e*.

In use and with reference to FIGS. 6*a* to 6*e*, the second coil 96 will be driven, demagnetizing or reducing the magnetic flux in the right-hand side 38', causing a corresponding increase in the magnetic flux in the left-hand side 36'. The left-hand side armlet 116*a* will therefore be attracted towards the first coil 94 and will latch at the left-hand side 36'. The left-hand side actuation element 84*a* will therefore slide upwards towards its first end 124*a*, simultaneously pushing the first and fourth movable arms 40*a*, 54*b*.

As the rocking armature 114 pivots about the fulcrum 108, the right-hand side armlet 116*b* will be actuated away from the second coil 96, sliding the right-hand side actuation element 84*b* towards its second end 126*b*, thereby pulling the second and third movable arms 54*a*, 40*b*. The left-hand side 84*a* latched configuration is shown in 6*a*.

As a result, the second movable arm 54*a* is pushed and fourth moveable arm 54*b* is pulled so as to open the secondary and quaternary contact sets 76, 82, the second and fourth moveable contacts 72*a*, 72*b* being brought out of contact with the first and third fixed contacts 50*a*, 50*b*.

Fractionally afterwards, simultaneous pushing of the first movable arm 40*a* and pulling of the third movable arm 40*b* opens the primary and tertiary contact sets 74, 80 as the first and third movable contacts 52*a*, 52*b* are brought out of contact with the respective second and fourth fixed contacts 70*a*, 70*b*.

Conversely, when the first coil 94 is driven, the left-hand side 36 is demagnetized or has imparted a reduced magnetic flux, and the left-hand side armlet 116*a* of the rocking armature 114 delatches from the first coil 94. The delatched state of the actuator 28 is shown in FIG. 6*b*.

The driving of the first coil 94 causes an increase in the magnetic flux in the right-hand side 38. The right-hand side armlet 116*b* will be attracted towards the second coil 96 and will latch at the right-hand side 38. The right-hand side actuation element 84*b* will therefore slide upwards towards its first end 124*b*, thereby pushing the second and third movable arms 54*a*, 40*b*. This position is shown in FIG. 6*c*.

Similarly the left-hand side armlet 116*a* will be actuated away from the first coil 94, sliding the left-hand side actuation element 84*a* downwardly towards its second end 126*a*, thereby pulling the first and fourth movable arms 40*a*, 54*b*.

The simultaneous pulling of the first movable arm 40*a* and pushing of the third movable arm 40*b* brings about closure of the primary and tertiary contact sets 74, 80 as the first and third movable contacts 52*a*, 52*b* are brought into contact with the respective second and fourth fixed contacts 70*a*, 70*b*. At this point, a circuit is completed, current being carried between the first and second terminals 12, 14 via the first moveable arm 40*a*, and between the third and fourth terminals 16, 18 via the third moveable arm 40*b*.

Fractionally afterwards, the second movable arm 54*a* is pushed and fourth moveable arm 54*b* is pulled so as to close the secondary and quaternary contact sets 76, 82, the second and fourth moveable contacts 72*a*, 72*b* being brought into contact with the first and third fixed contacts 50*a*, 50*b*.

Once the secondary and quaternary contact sets 76, 82 are closed, the current is shared between the first and third moveable arms 40*a*, 40*b*, and the left and right blades 62*a*, 64*a*, 62*b*, 64*b* of the second and fourth moveable arms 54*a*, 54*b*.

The first advantage of having moveable arm pairs 78*a*, 78*b* for the contactor 10 is that current is shared between the individual arms, enabling the lead-lag configuration as described above, leading in turn to a corresponding reduction in the amount of precious metal required to form the contacts. The advantages of moveable arm pairs 78*a*, 78*b* will be described for the first and second moveable arms 40*a*, 54*a*, but the concepts will be equally applicable to the third and fourth moveable arms 40*b*, 54*b*.

In the present embodiment, the first moveable arm 40*a* is the lead arm, and is a singular blade with a large first moveable contact 52*a*. The first moveable contact 52*a* will contact with the second fixed contact 70*a* to close the primary contact set 74 before the secondary contact set 76 is closed. The first moveable contact 52*a* must be large in order to inhibit tack welding, since the entirety of the current will be transferred through the primary contact set 74 at this point.

The left and right blades 62*a*, 64*a* of the second moveable arm 54*a* actuate fractionally after the first moveable arm 52*a*. Therefore, by the time the second moveable contacts 72*a* come into contact with the first fixed contacts 50*a*, there will be a lower risk of tack-welding. Therefore these lag contacts 72*a*, 50*a* can be smaller than the corresponding contacts 70*a*, 52*a* of the primary contact set 74. Since the circuit has already been completed, there is a reduced likelihood of arcing between the contacts, and therefore reduced likelihood of arc welding.

Upon closure of both primary and secondary contact sets 74, 76, current will be flowing through both of the first and second moveable arms 40*a*, 54*a* in the same direction. In accordance with Ampere's law, the magnetic fields generated within the moveable arms 40*a*, 54*a* will result in each moveable arm 40*a*, 54*a* experiencing an attractive force from the other.

As the moveable arms 40*a*, 54*a* are attracted to one another, the closure force keeping the primary and secondary contact sets 74, 76 in position is accordingly increased. This limits the likelihood of contact bounce, which can increase the risk of arcing and subsequent damage to the contacts.

Not only is there magnetic interaction between the first and second moveable arms 40*a*, 54*a* and third and fourth moveable arms 40*b*, 54*b*, but there will also be a weaker interaction between the second and fourth moveable arms 54*a*, 54*b*. Since the current flows from the first terminal 12 to the second terminal 14 and from the third terminal 16 to the fourth terminal 18, the current through the second and fourth moveable arms 54*a*, 54*b* will be flowing in opposite directions.

The second and fourth moveable arms 54*a*, 54*b* are further apart than the first and second moveable arms 40*a*, 54*a*, for instance, and in accordance with Ampere's Law, the magnetic interaction will be accordingly weaker. However, the interaction will be repulsive, due to the contra-flowing current, thereby increasing the contact pressure on the secondary and quaternary contact sets 76, 82. This will again advantageously inhibit the likelihood of contact bounce.

To then re-open the contacts, the second coil 96 may be driven again, thereby causing a demagnetization in the right-hand side 38, the right-hand side armlet 116*b* of the rocking armature 114 delatching from the second coil 96. This delatched state of the actuator 28 is shown in FIG. 6*d*. The subsequent increase in magnetic flux in the first coil 94 will then attract the left-hand side armlet 116*a*, causing it to latch to the first coil 94, completing the actuation cycle as shown in FIG. 6*e*.

The driving of the coils 94, 96 of the actuator 28 can be achieved in a variety of ways.

Firstly, the finish of the coil winding 100*a* of the first coil 94 may be connected to the start of the coil winding 100*b* of the second coil 96 via a Common connection 136. The two windings 100*a*, 100*b* are wound around their respective cores 98*a*, 98*b* in the same direction, face-to-face, in series. Each coil 94, 96 may then be DC pulse-driven, by a DC power supply through an appropriate drive circuit, separately to achieve the rocking actuation as previously described.

Alternatively, since the actuator 28 is fast acting when driven strongly, the DC pulse may be replaced with an AC driving pulse. Since the windings 100*a*, 100*b* are connected in series, the coils 94, 96 may be driven by a single AC pulse from an AC power supply through an appropriate drive circuit, the positive cycle of the pulse energizing and demagnetizing the second coil 96 and closing the contacts, and the negative cycle of the pulse energizing and demagnetizing the first coil 94 and opening the contacts.

Although the coils are preferably connected in series, if may be feasible to connect the coils in other configurations to achieve the same or similar end result.

The advantage of an AC driving pulse is that when the driven coil 94, 96 is energized and therefore demagnetized or having a reduced magnetic flux, the other coil 96, 94 experiences an induced electromagnetic field, causing a mean tempering flux and damping effect during the pivoting of the rocking armature 116. This damping effect delays and stabilizes the contact closing time, more or less proportionally to the supply voltage amplitude.

Additionally, by providing a driving pulse having a truncated waveform profile, such as a half-cycle drive pulse, a quarter cycle drive pulse, and/or possible further truncation variants, the possible contact erosion energy available to be discharged on contact closure can be significantly reduced.

Figure 7:
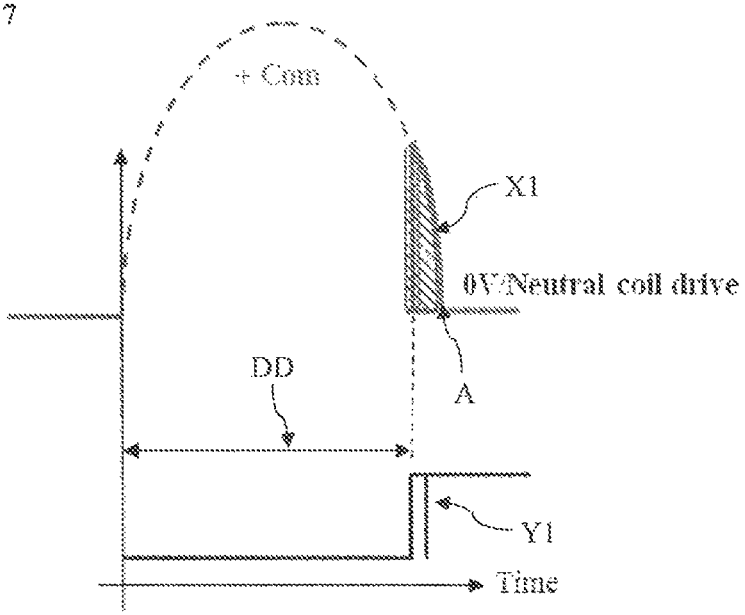
FIG. 7 graphically represents the additional control over the closing of the contacts provided by the electrical contactor when driven by a positive half-cycle drive pulse.
Figure 8:
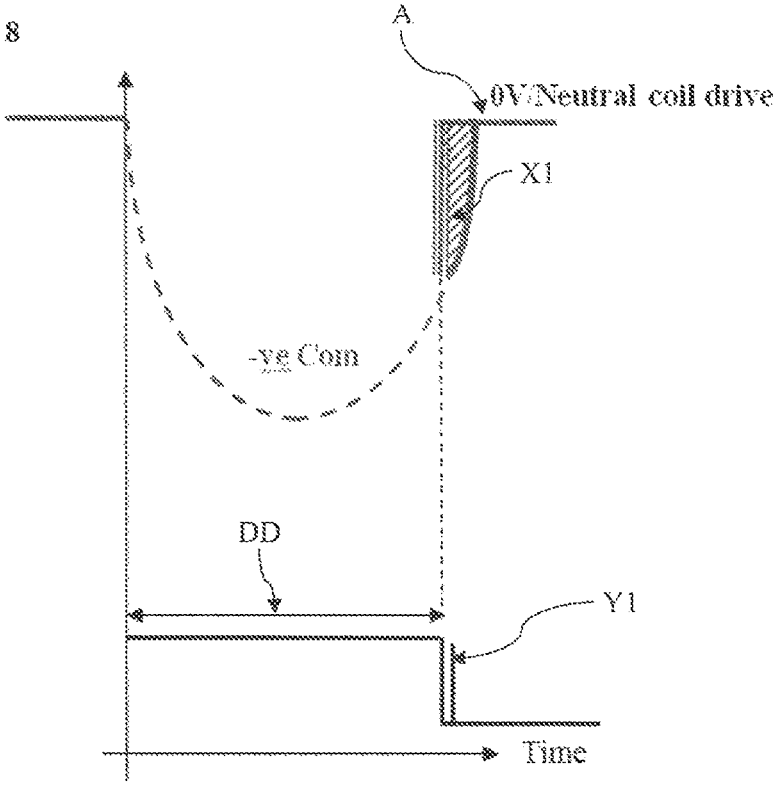
FIG. 8, similarly to FIG. 7, graphically represents the additional control over the opening of the contacts provided by the electrical contactor when driven by a negative half-cycle drive pulse.
Figure 9:
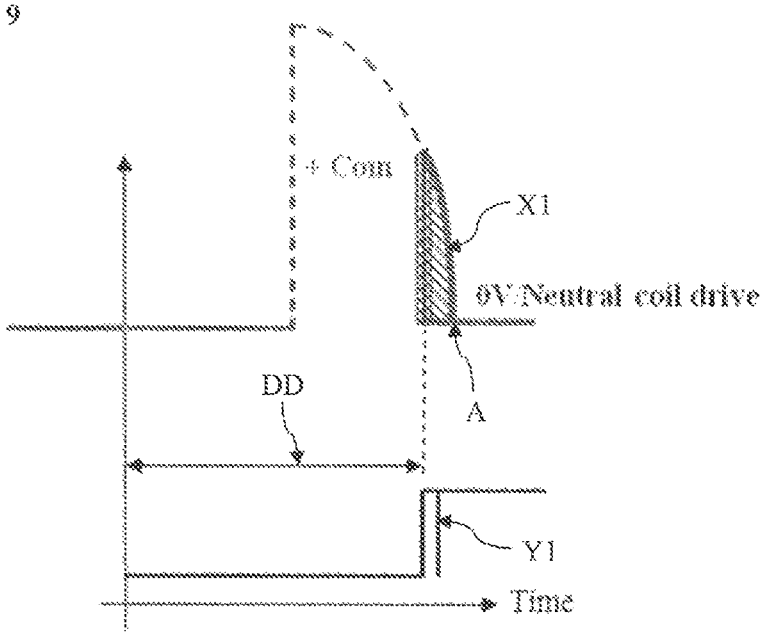
FIG. 9 graphically represents the additional control over the closing of the contacts provided by the electrical contactor when driven by a positive quarter-cycle drive pulse.
Figure 10:
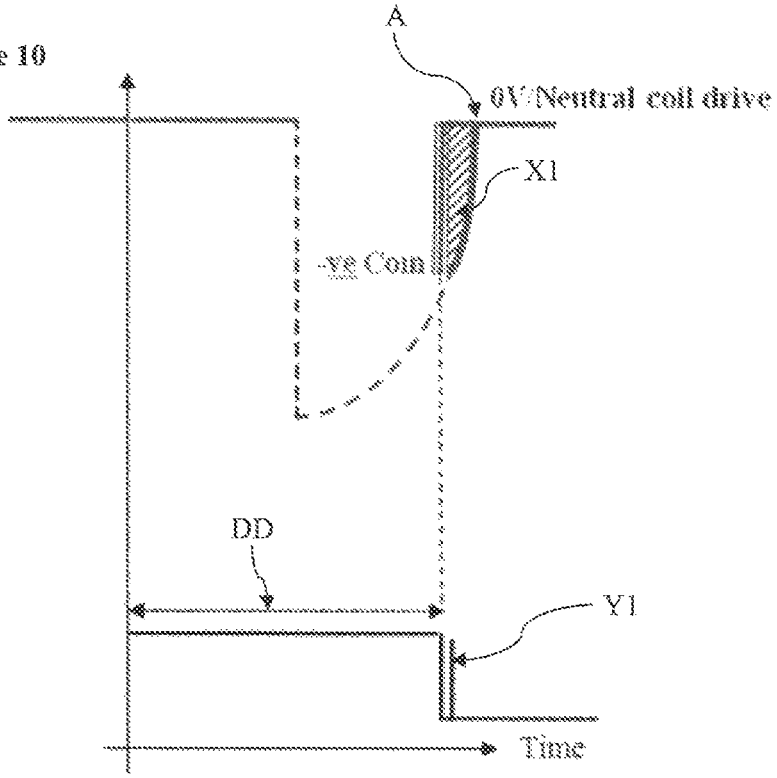
FIG. 10, similarly to FIG. 9, graphically represents the additional control over the opening of the contacts provided by the electrical contactor when driven by a negative quarter-cycle drive pulse.

As shown in FIGS. 7 and 8 for the case of a half-cycle drive pulse, or FIGS. 9 and 10 for a quarter-cycle drive pulse, the contact opening time can be controlled and therefore shifted to or adjacent to the AC load waveform zero-crossing point A, by carefully matching the coils, the strength of the feedback connection, and therefore the controlled delay of the opening of the contacts. As such arcing and thus contact erosion energy X1 is reduced or eliminated, prolonging contact life or improving endurance life. Possible contact bounce Y1, is also shifted to or much closer to the zero-crossing point A, again improving contact longevity and robustness during opening.

By way of example, a standard or traditional contact opening and closing time may include a dynamic delay DD of 5 to 6 milliseconds, primarily due to the time taken to delatch the rocking armature 90. By using the control of the present invention, this dynamic delay is fractionally extended to 7 to 8 milliseconds to coincide more closely or synchronize with the next or subsequent zero-crossing point of the AC load waveform. Synchronization or substantial synchronization of the dynamic delay DD with the zero-crossing point A will reduce arcing and contact erosion energy. The AC drive pulse may preferably be shaped so as to have a half-cycle pulse profile to achieve this delay.

If the contactor 10 is used over a wide range of supply voltages, the dynamic delay DD can vary greatly between the different voltages. The higher the supply voltage, the more rapid the actuation of the rocking armature. As a result, with a half-cycle drive pulse, there is a possibility of a very short dynamic delay DD, which may lead to contact closure occurring at or before the peak load current.

If the dynamic delay DD is short due to a high or higher AC supply voltage. The subsequent contact erosion energy X1 may be very large. This large contact erosion energy X1 may damage the contacts, lessening their lifespans.

The contact erosion energy X1 can be further reduced by using an AC supply which energizes the coils 94, 96 with a truncated drive pulse, in this case preferably being a quarter-cycle drive pulse, in place of the half-cycle drive pulse. In this arrangement, the quarter-cycle drive pulse will not trigger and thus drive the first or second drive coil 96, 94 until the peak load current is reached. As such, this can be considered a 'delayed' driving approach.

By triggering the truncated-cycle, being in this case a quarter-cycle, drive pulse on the peak load current, the closing of the contacts can never occur prior to the peak load current. However, by utilizing a control circuit as part of the power supply outputting to the electrical actuator, a degree of truncation of the current waveform on the time axis can be carefully selected and optimized based on the peak load current, the required contact opening and closing force and delay, and the arc and/or erosion energy imparted to the contacts during the contact opening and closing procedures. As such, although a quarter-cycle drive pulse is preferred, since this coincides with the peak load current, it may be beneficial for a controller outputting an energization current to the actuator to be set to truncate the waveform of the drive pulse to be prior or subsequent to the peak load current.

The dynamic delay DD is still preferably configured to synchronize or substantially synchronize with the zero-crossing point A, thereby minimizing the contact erosion energy X1 even further. However, when utilized together with the controlled truncated waveform of the drive pulse, this is achieved in a more controlled manner than with the half-cycle drive pulse.

Although the AC drive pulse may be truncated, it may be feasible to also truncate the DC drive pulse, which in some situations may be beneficial in terms of reducing arcing and/or contact erosion.

It will be appreciated that the present invention as described above is merely a single embodiment, and other means of achieving the same result can be conceived. For instance, the fulcrum of the rocking armature is described as being a pivot pin attached to the cap plate of the yoke of the actuator. However, any suitable pivoting means could be utilized as part of the contactor, provided that the resultant actuation were the same.

It has also been mentioned that the slidable actuation elements of the actuation means are arranged so as to actuate the moveable arms in a lead-lag manner. This is achieved by the specific arrangement of the slotted lifters of the slidable actuation elements; the lead slotted lifters being closer to their respective contact than the lag lifters.

However, there are alternative possible arrangements which could be conceived. For instance, the tangs of the lagging moveable arms may not be tightly held within their respective slotted lifters, and therefore may be actuated later than the lead moveable arms as a result.

Whilst the fixed contacts in the contactor are described as being a single monolithic contact which may contact with multiple movable contacts, it may be preferable to provide a corresponding plurality of fixed contacts thereby reducing the amount of material used to create the fixed contacts.

It is thus possible to provide an electrical contactor having at least one pair of terminals which are interconnectable by a current-sharing pair of moveable arms. As the moveable arms share the current load, the contact erosion energy is greatly reduced, leading to a more long-lived contactor.

Furthermore, the moveable arm pair may be arranged so as to magnetically attract one another, thereby increasing the closure force on the contacts when closed. This advantageously inhibits contact bounce, which may cause damage to the contact pads.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. An electrical contactor comprising:

a first terminal having at least one first fixed electrical contact;

a second terminal having at least one second fixed electrical contact;

a first electrically-conductive movable arm in electrical communication with the first terminal and having at least one first movable electrical contact thereon;

a second electrically-conductive movable arm in electrical communication with the second terminal and having at least one second movable electrical contact thereon, counter-opposed to the first electrically-conductive moveable arm;

a third terminal having a third fixed member with at least one third fixed electrical contact;

a fourth terminal having a fourth fixed member with at least one fourth fixed electrical contact;

a third electrically-conductive movable arm in electrical communication with the third terminal and having at least one third movable electrical contact thereon;

a fourth electrically-conductive movable arm in electrical communication with the fourth terminal and having at least one fourth movable electrical contact thereon, counter-opposed to the third electrically-conductive moveable arm; and an actuator providing motive force to the first and second electrically-conductive moveable arms in opposing directions, and to the third and fourth electrically-conductive moveable arms in opposing directions, wherein the or each first moveable electrical contact and the or each second fixed contact form a primary contact set, and the or each second moveable electrical contact and the or each first fixed contact form a secondary contact set, counter-opposed first and second moveable arms thereby forming a current-sharing arm pair between first and second terminals;

wherein the current through the counter-opposed first and second moveable arms flows in the same direction, thereby creating an attractive magnetic force between the first and second moveable arms;

wherein the or each third moveable electrical contact and the or each fourth fixed contact form a tertiary contact set, and the or each fourth moveable electrical contact and the or each third fixed contact form a quaternary contact set, third and fourth moveable arms thereby forming a further current-sharing arm pair between third and fourth terminals;

wherein the current through the counter-opposed third and fourth moveable arms flows in the same direction, thereby creating an attractive magnetic force between the third and fourth moveable arms, wherein the current flow through the counter-opposed third and fourth moveable arms flows parallel and in opposition to the current flow through the first and second moveable arms, and wherein a repulsive magnetic force is created between the second and fourth moveable arms as a result of the parallel and opposite current flow between the current-sharing arm pair, and the further current-sharing arm pair.

2. The electrical contactor of claim 1, wherein the primary contact set is a lead contact and the secondary contact set is a lag contact, the actuator being adapted to actuate the first moveable electrical contact into contact with the second fixed electrical contact before the second moveable electrical contact is actuated into contact with the first fixed electrical contact.

3. The electrical contactor of claim 1, wherein at least one of the moveable arms has a single-blade arrangement.

4. The electrical contactor of claim 3, wherein the first moveable arm has a single-blade arrangement, having the first moveable contact thereon, the second fixed contact being sized and positioned to match the first moveable contact.

5. The electrical contactor of claim 1, wherein at least one of the moveable arms has a split-blade arrangement.

6. The electrical contactor of claim 5, wherein the second moveable arm has a split-blade arrangement including two blades, two of the second moveable contacts being provided, one on each blade, there being two first fixed contacts sized and positioned to match the two second moveable contacts.

7. The electrical contactor of claim 1, wherein the contacts of the primary contact set are dimensioned differently to the contacts of the secondary contact set.

8. The electrical contactor of claim 7, wherein the contacts of the primary contact set are larger than the contacts of the secondary contact set.

9. The electrical contactor of claim 1, wherein the tertiary contact set is a lead contact and the quaternary contact set is a lag contact, the actuator being adapted to actuate the third moveable electrical contact into contact with the fourth fixed electrical contact before the fourth moveable electrical contact is actuated into contact with the third fixed electrical contact.

10. The electrical contactor of claim 1, wherein the third moveable arm, terminal, fixed contact and moveable contact are identical or substantially identical in form and/or orientation to the first moveable arm, terminal, fixed contact and moveable contact.

11. The electrical contactor of claim 1, wherein the fourth moveable arm, terminal, fixed contact and moveable contact are identical or substantially identical in form to the second moveable arm, terminal, fixed contact and moveable contact.

12. The electrical contactor of claim 1, wherein the actuator includes a centrally mounted magnet, first and second drivable coils located either side of the magnet, a magnetically-attractable rocking armature pivotable at a point between the first and second coils, and an actuation element connected to an end of the rocking armature for actuating each movable arm; wherein driving the first coil causes a decrease of magnetic flux in the first coil, causing a corresponding increase in magnetic flux in the second coil, the rocking armature thus latching to the second coil, thereby actuating each movable arm in a first direction, and driving the second coil causes a decrease of magnetic flux in the second coil, causing a corresponding increase in magnetic flux in the first coil, the rocking armature thus latching to the first coil, thereby actuating each movable arm in a second direction.

13. The electrical contactor of claim 12, wherein the first and second coils are interconnected to a common center connection.

14. The electrical contactor of claim 12, wherein the rocking armature includes two armlets positioned at an obtuse angle to one another.

* * * * *